US006607549B2

(12) United States Patent
Huang

(10) Patent No.: US 6,607,549 B2
(45) Date of Patent: Aug. 19, 2003

(54) ORAL REHABILITATION DEVICE

(75) Inventor: Chang-Lung Huang, San Chung (TW)

(73) Assignee: Pro David Inc., San Chung (TW)

( * ) Notice: Subject to any disclaimer, the term of this patent is extended or adjusted under 35 U.S.C. 154(b) by 252 days.

(21) Appl. No.: 09/734,170

(22) Filed: Dec. 12, 2000

(65) Prior Publication Data

US 2002/0165568 A1 Nov. 7, 2002

(51) Int. Cl.[7] ..... A61H 1/00; A63B 23/03
(52) U.S. Cl. ..... 606/234; 601/38; 482/11
(58) Field of Search ..... 606/191, 198, 606/192, 193, 194, 195, 196, 197, 199, 200, 234, 235; 128/859, 861, 862, 848; 601/139, 38, 141; 482/11, 121; 602/902

(56) References Cited

U.S. PATENT DOCUMENTS 242,443 A * 6/1881 Foote ..... 606/198
1,271,456 A * 7/1918 Flack ..... 606/197
1,586,449 A * 5/1926 Worth ..... 606/234
1,749,632 A * 3/1930 Ferris ..... 606/234
2,091,511 A * 8/1937 London ..... 606/234
3,118,667 A * 1/1964 Barons ..... 601/38
4,281,658 A * 8/1981 Child ..... 606/191
5,163,949 A * 11/1992 Bonutti ..... 606/192
5,325,848 A * 7/1994 Adams et al. ..... 606/198
5,370,134 A * 12/1994 Chin et al. ..... 128/898
6,524,225 B1 * 2/2003 Arias ..... 482/11

* cited by examiner

*Primary Examiner*—A. Vanatta
(74) *Attorney, Agent, or Firm*—Rosenberg, Klein & Lee

(57) ABSTRACT

An oral rehabilitation device for helping patients to expand oral cavity includes a body for prying the upper and lower jaws open and at least one pressure-resistant blade held in the body to expand the oral cavity to an extent desired. The body may also form a support section at one end to contain an expansion element inside. The expansion element has restoration force which couples the expansion force of the support section may further expand oral cavity to an extent desired for achieving oral rehabilitation object.

1 Claim, 8 Drawing Sheets

ORAL REHABILITATION DEVICE

FIELD OF THE INVENTION

This invention relates to an oral rehabilitation device and particularly a device that is simply structured, effective and capable of protecting oral organ, and may be produced at low cost.

BACKGROUND OF THE INVENTION

Cancer has long been a horror disease like nightmare to human being. With rapid medical technology innovation in recent years, a lot of cancers are curable if found out early and have been treated properly. Oral cancer is one of the instances. Some oral cancer patients will suffer from oral fibrosis at the later stage of oral cancer. Patients who have this problem cannot open their upper and lower jaws properly, or in severe cases, even cannot open the jaws at all. In order to help the patients to recover, oral rehabilitation exercise is very important during therapy treatment. Oral rehabilitation exercise is also needed in some other occasions such as for patients who have cheek surgical operation. Hence a good tool or device for patients to do oral rehabilitation exercise is much needed.

There are oral rehabilitation devices available in the market place. FIG. 1-1 illustrates one of the examples. It is constructed like a hand gun. It has a pair of movable upper tooth pad and lower tooth pad located at one end. There is a slant lever at one side which may be pressed to control the opening of the upper and lower tooth pad. When in use, the patient puts the closed tooth pads into oral cavity and uses the teeth to bite the upper and lower tooth pad (Shown in FIG. 1-2). Then press the slant lever to open the upper and lower tooth pad (shown in FIG. 1-3) for pushing the upper and lower jaws apart. Such a tool can only open the upper and lower jaws in one direction. It does not have elastic restoration power to facilitate opening and closing of the jaws. The rehabilitation effect is limited and takes longer time. Its structure is quite complicated and is costly to produce.

Some people use tongue depressor (shown in FIG. 1-4) used mostly by physicians for oral rehabilitation purpose. It usually is an elongate blade made of wood. Put one or more piece of the blade into oral cavity and levering it up and down, the jaws may be opened and extended. It is simple and costs little. However it has some degree of risk when using it. For instance, if the blade is made of wood of relatively hard nature, it might hurt oral tissues. If levering the blade with too much force, it could break or crack and harm oral tissues, and might have hazardous consequence. Hence there is still a need for designing a low cost and simple to use oral rehabilitation device.

SUMMARY OF THE INVENTION

In view of the foregoing disadvantages, it is therefore an object of this invention to provide a simple assembly that may be used to expand oral cavity easily for doing oral rehabilitation exercise.

Another object of this invention is to simplify the structure for lowering rehabilitation cost.

Still another object of this invention is to provide protection for the patients so that they won't be hurt during doing oral rehabilitation exercise.

BRIEF DESCRIPTION OF THE DRAWINGS

The invention, as well as its many advantages, may be further understood by the following detailed description and drawings, in which:

FIG. 1-2 is a fragmentary close-up view of the oral rehabilitation tool shown in FIG. 1 in use;

FIG. 1-3 is anther pictorial view of the oral rehabilitation tool shown in FIG. 1 in use;

FIG. 1-4 is a pictorial view of another conventional oral rehabilitation tool;

FIG. 2-1 is an exploded view of a first embodiment of the present invention;

FIG. 2-2 is a side view of the first embodiment of the present invention;

FIG. 2-3 is a side view of an embodiment variation of the first embodiment of the present invention;

FIG. 2-4 is a pictorial view of the first embodiment in use;

FIG. 2-5 is another pictorial view of the first embodiment in use;

FIG. 3-1 is an exploded view of a second embodiment of the present invention;

FIG. 3-2 is a side view of the second embodiment of the present invention;

FIG. 3-3 is a pictorial view of the second embodiment in use;

FIG. 3-4 is another pictorial view of the second embodiment in use;

FIG. 4-1 is a perspective view of a third embodiment of the present invention;

FIG. 4-2 is a pictorial view of the third embodiment in use; and

FIG. 4-3 is another pictorial view of the third embodiment in use.

DESCRIPTION OF THE PREFERRED EMBODIMENTS

Figure 1:
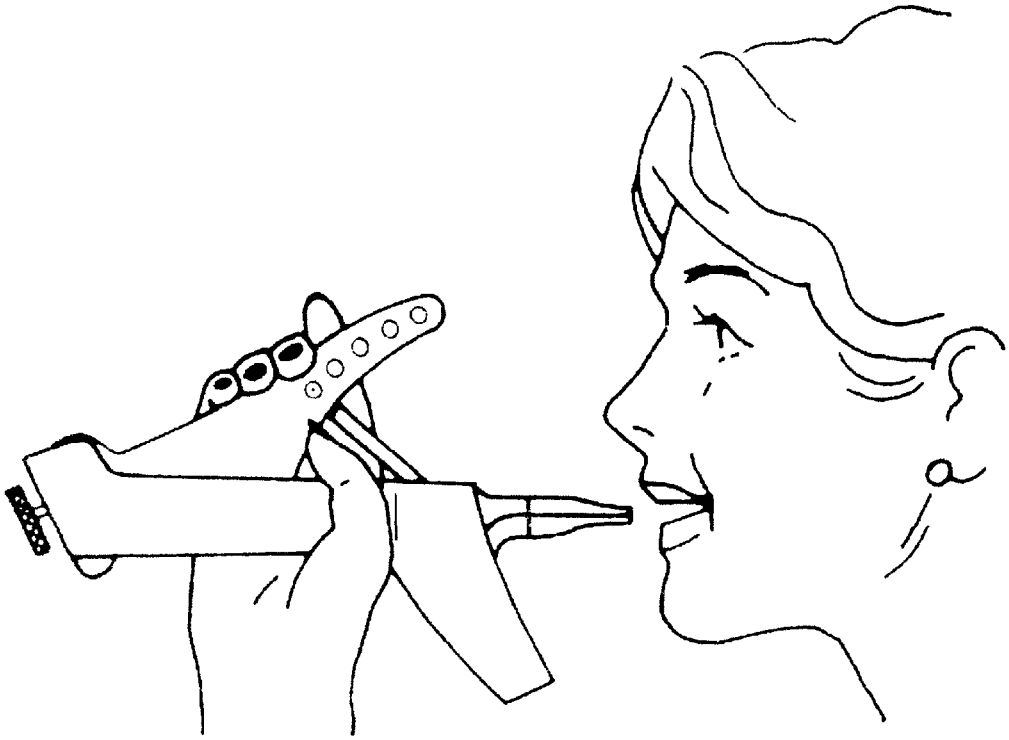
FIG. 1-1 prior art
FIG. 1-1 is a pictorial view of a conventional oral rehabilitation tool.
Figures 1, 2:
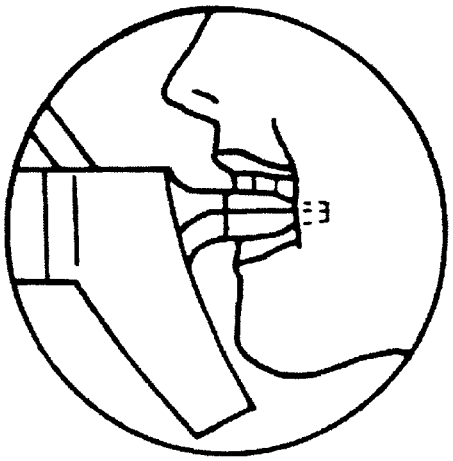
FIG. 1-2 prior art

Referring to FIGS. 2-1 and 2-2 which show the first embodiment of this invention. It includes an elongate body 1 made of a tenacious material (such as plastics, leather, or the like) and one or more pressure-resistant blade 2. The body 1 has a transverse compartment 11 with two side openings. The pressure-resistant blade 2 is made of a rigid material (such as wood, hard type plastics, metal or the like), and has a size fit for containing in the compartment 11. When the blade 2 is held in the compartment 11, the body 1 becomes sturdy and stronger because of the blade 2 and may be used for expanding patient's oral cavity. As the body 1 is made of a tenacious material, it won't hurt the patient when used properly. Once patient's oral cavity has been opened to a selected extent, one or more blade 2 may be added in the compartment 11 (shown in FIG. 2-3) to extend the cross section of the body 1 for expanding oral cavity to a larger extent until it reaches a normal condition desired.

Figures 1, 2, 3:
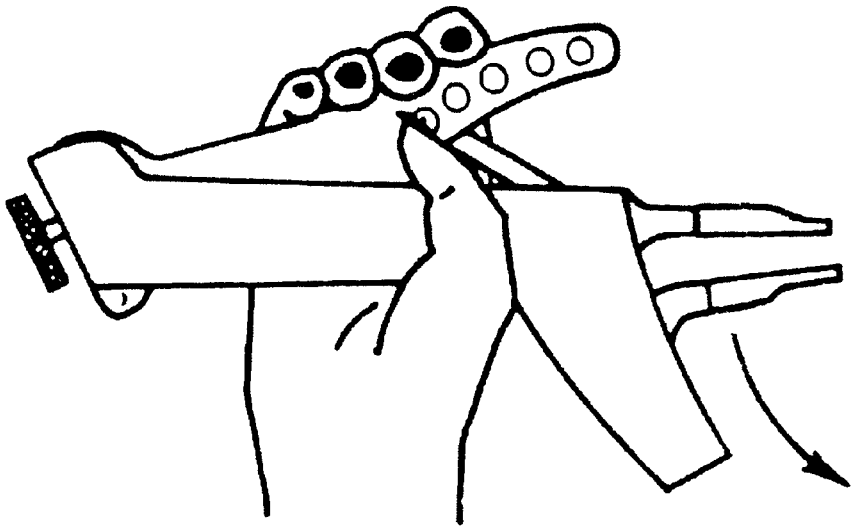
FIG. 1-3 prior art

FIGS. 2-4 and 2-5 depict the first embodiment in use. When a patient has oral illness and cannot open the jaws and mouth properly, and needs oral rehabilitation tools to restore oral cavity expansion capability, the body 1 with one blade 2 contained in the compartment 11 may be used to insert slowly into patient's mouth between the upper and lower jaws with the teeth crunching on the body 1. As the body 1 is made of a tenacious material, it won't hurt the oral tissues when using properly. Once patient's mouth is pried opened, more blades 2 may be gradually put into the compartment 11 to expand the oral cavity to a larger extent. The addition of the blade 2 may be done gradually depends on patient's rehabilitation progress unit it reaches a normal condition desired FIGS. 3-1 and 3-2 illustrate the second embodiment of this invention. It has a body 1 made of a tenacious material and an expansion element 3. One end of the body 1 is extended to form a support section 12 which is integrally formed with the body 1. The support section 12 is substantially an annular hollow member. The expansion element 3 is an elongate strip and is made of a tenacious material, and may be curled to a roll to be disposed in the hollow portion of the support section 12 for expanding patient's oral cavity.

Figures 1, 2, 3, 4:
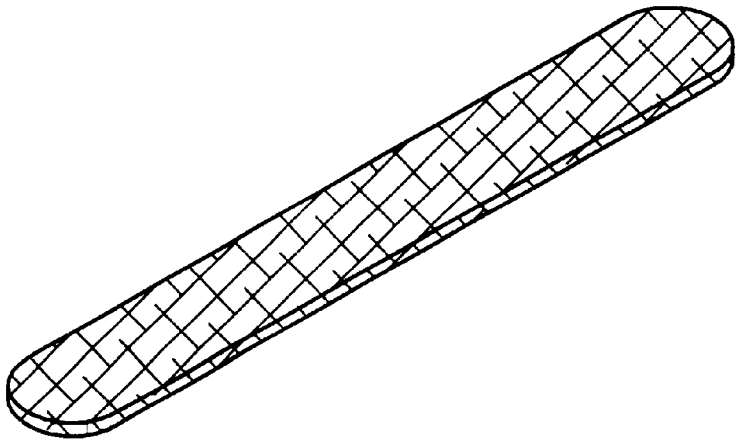
FIG. 1-4 prior art
Figures 1, 2:
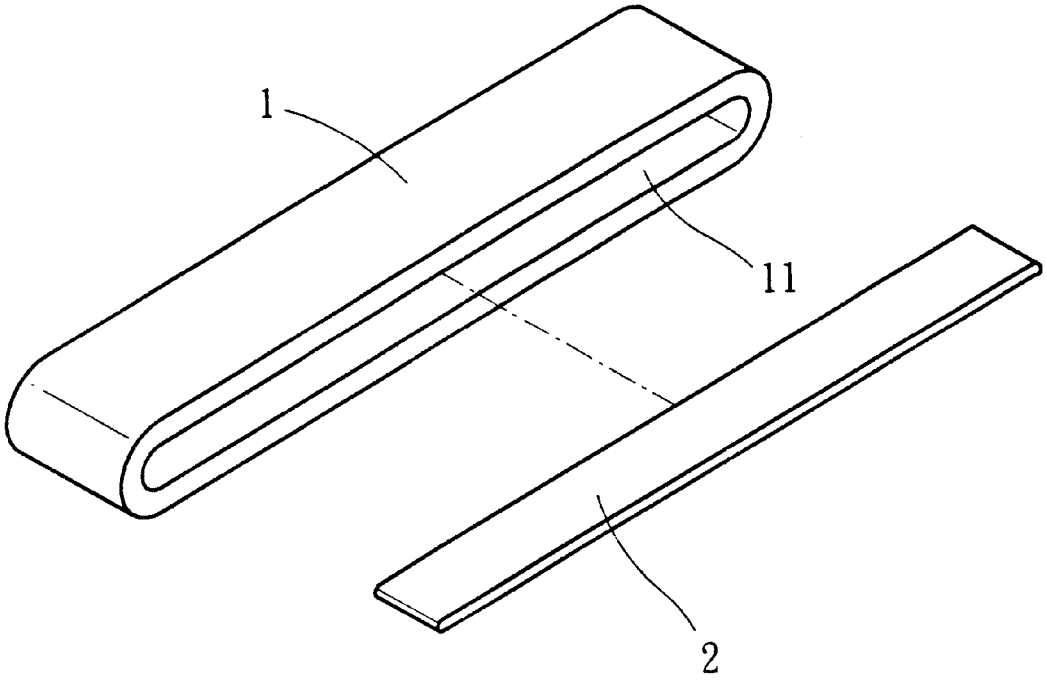
Figure 2:
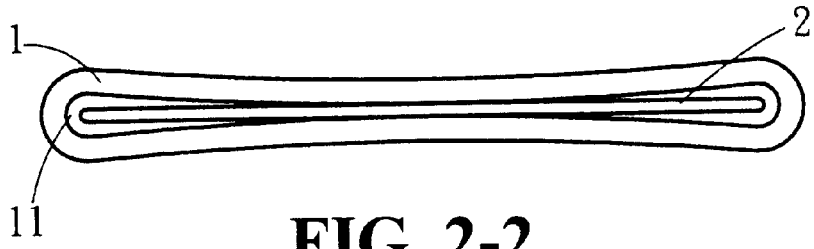
Figures 2, 3:
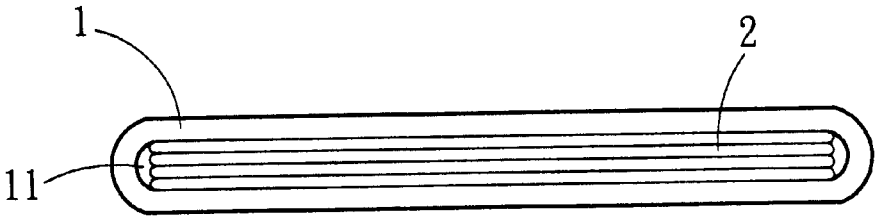
Figures 2, 3, 4, 5:
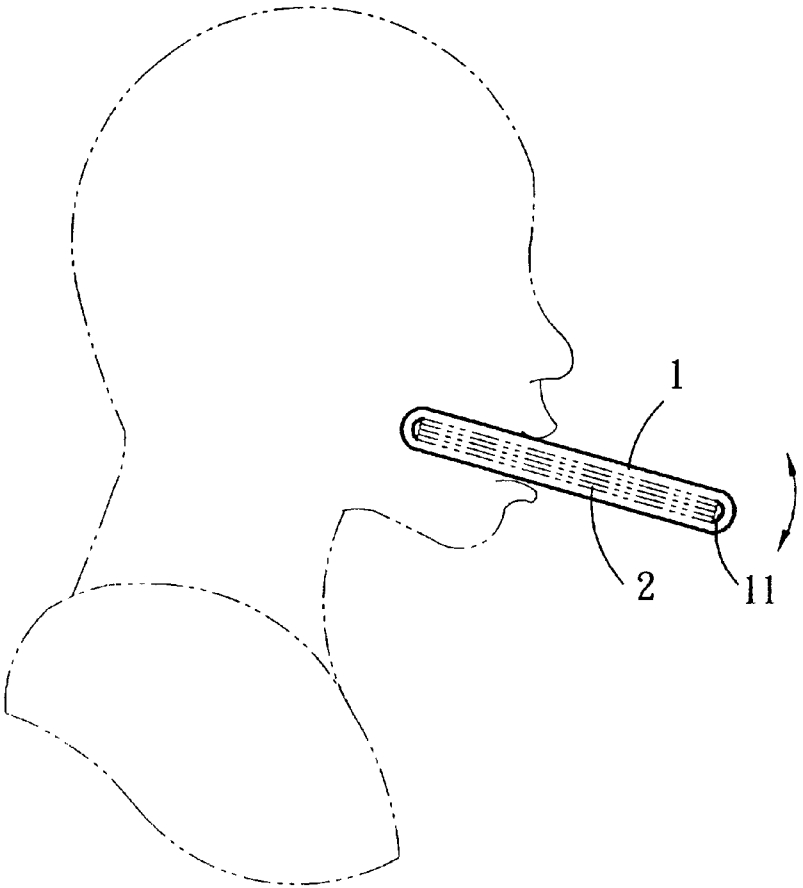
Figures 2, 3, 4:
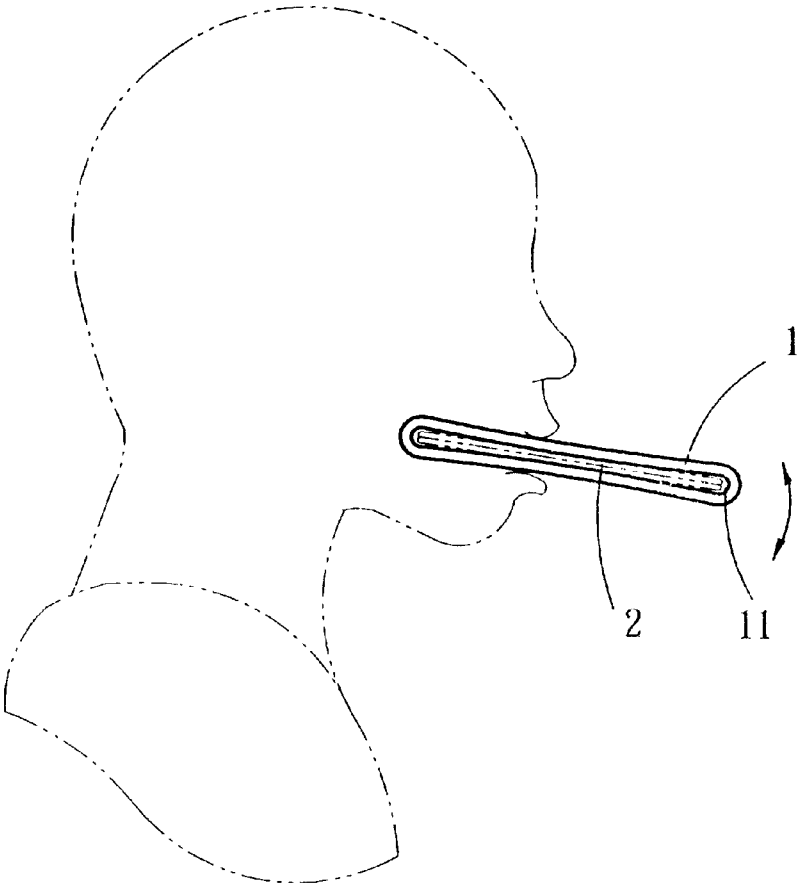
Figures 1, 3:
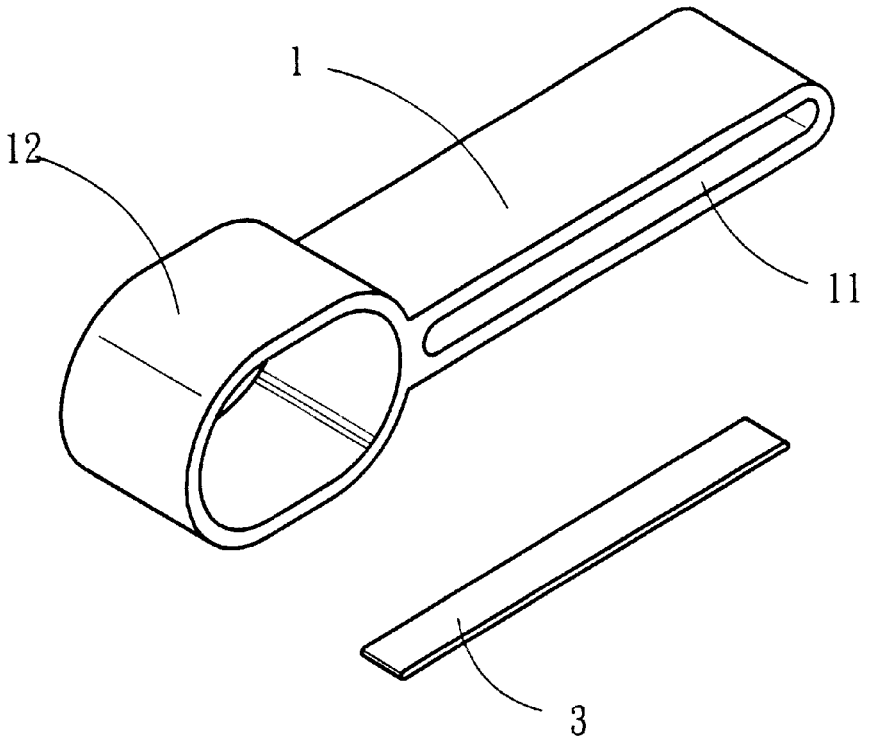
Figures 2, 3:
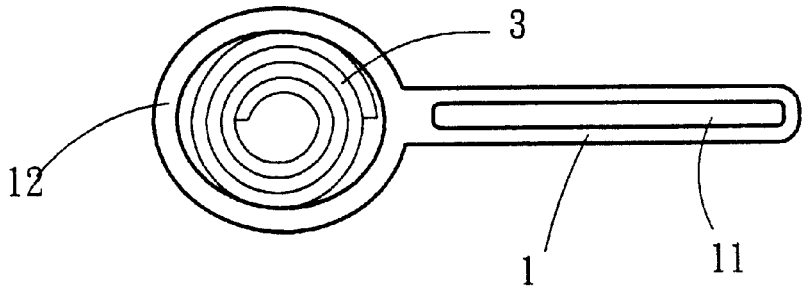
Figures 3, 4:
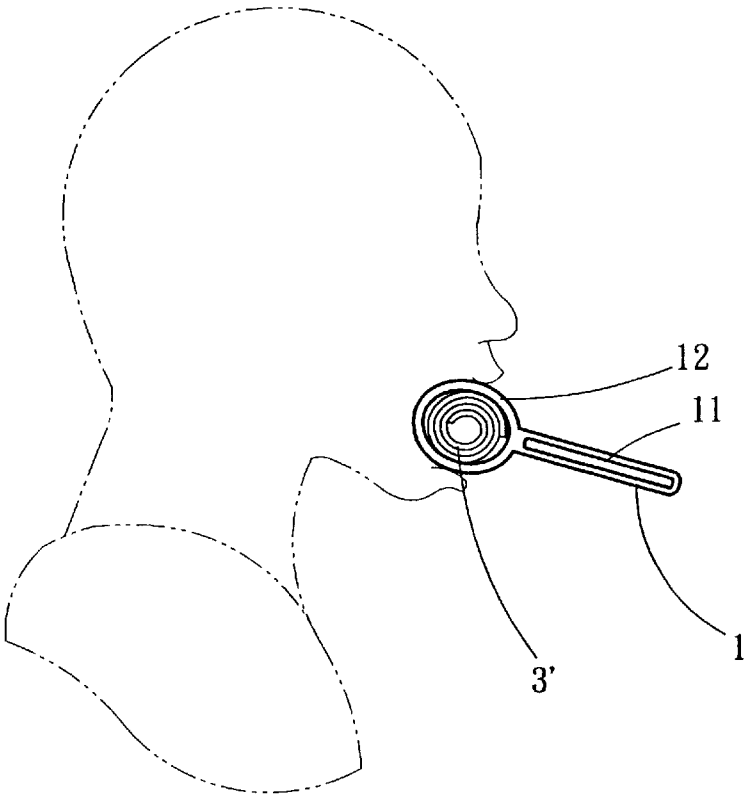
Figure 3:
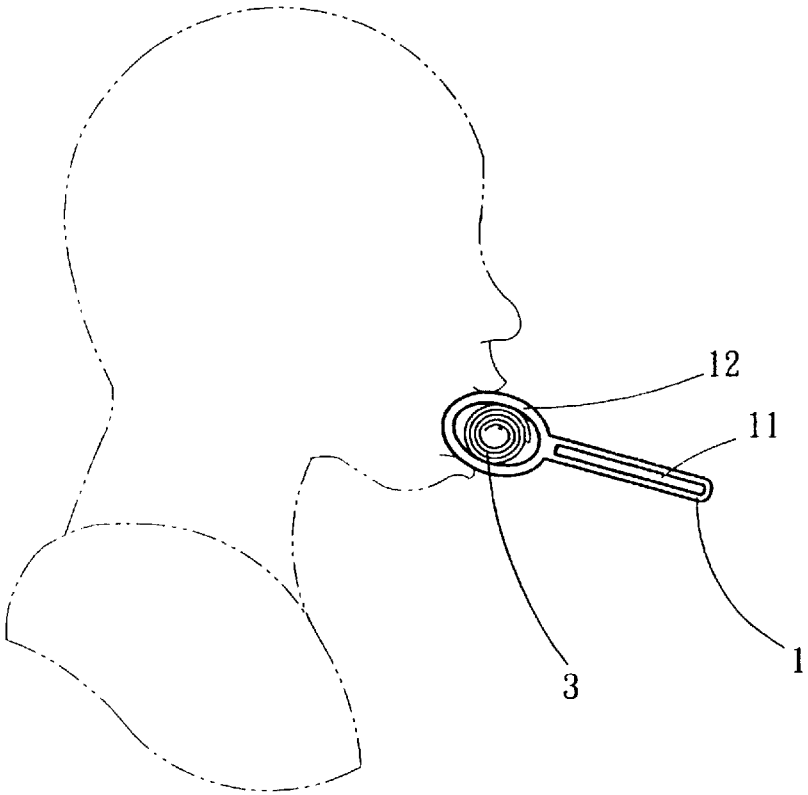
Figures 1, 4:
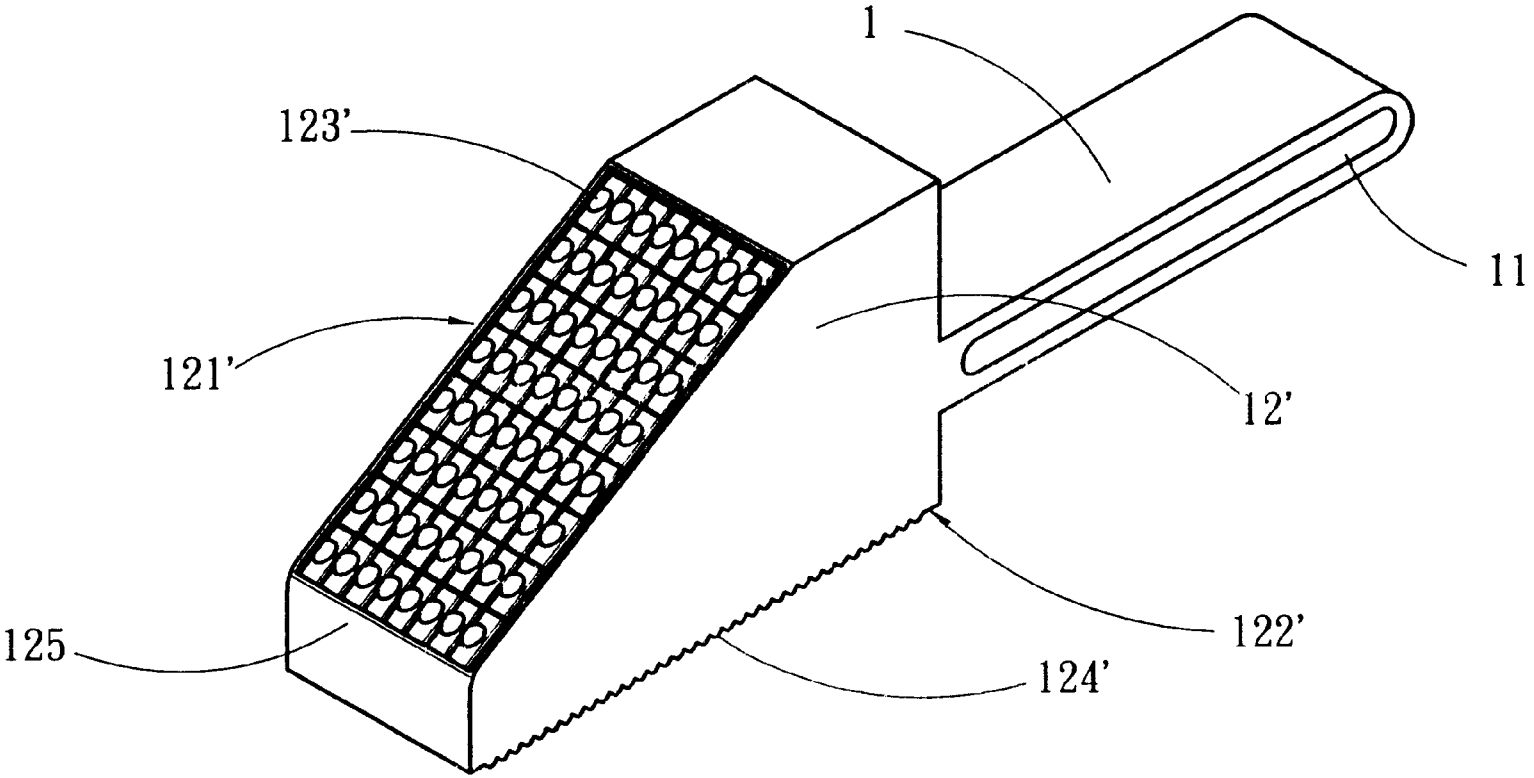
Figures 3, 4:
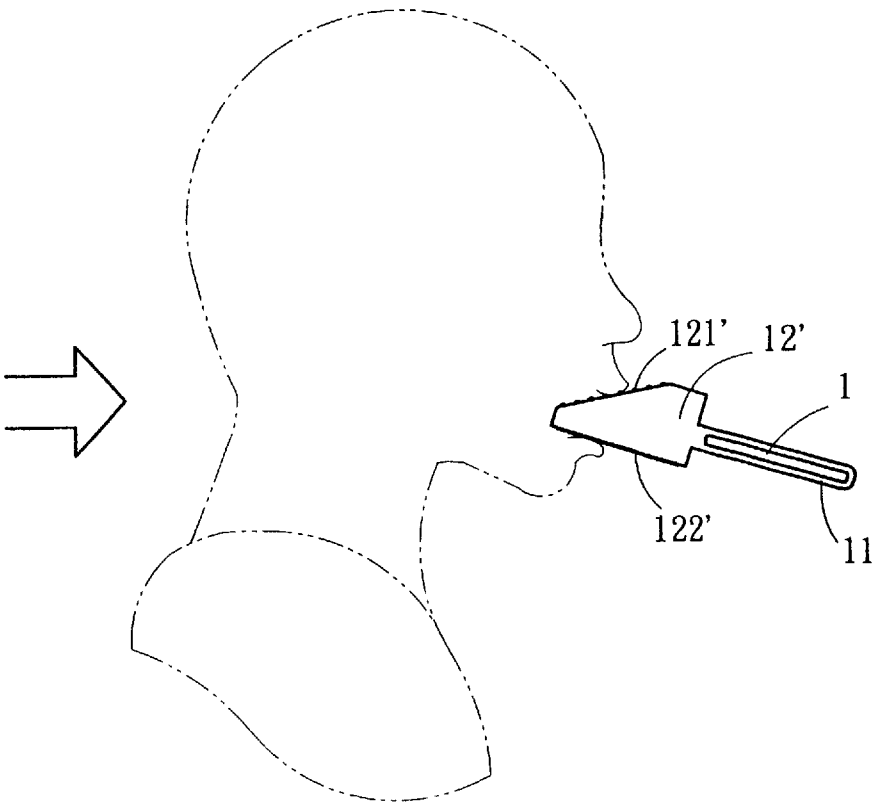
Figures 2, 4:
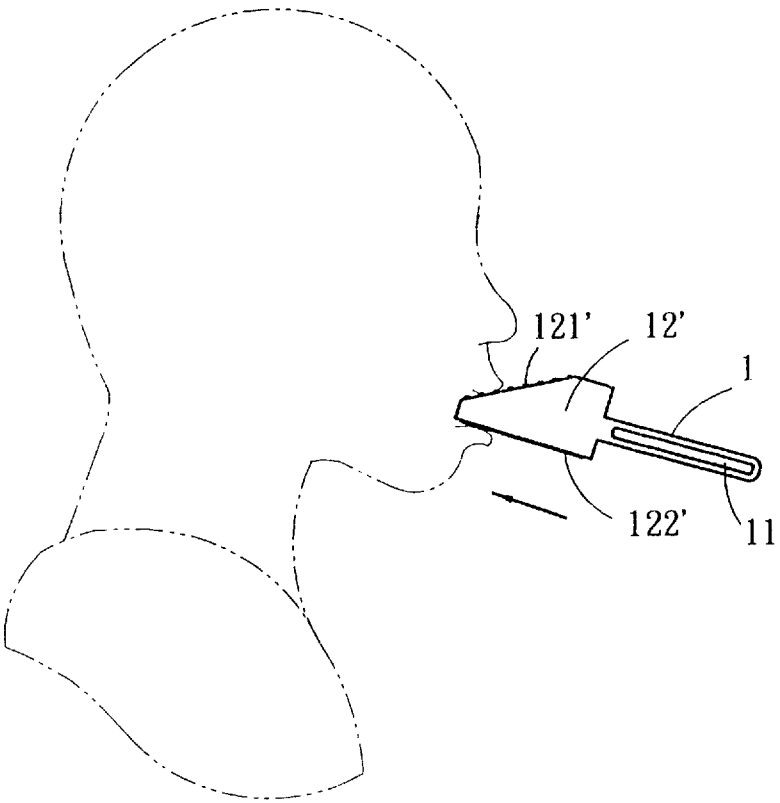

FIGS. 3-3 and 3-4 show the second embodiment in use. This embodiment may be used when patient's oral cavity can open to a certain degree. When in use, curl the expansion element 3 into the support section 12, then insert the expanded support section 12 into patient's mouth between the upper and lower jaws. The expansion element 3 has restoration force which exerts a force on the support section 12 to enable the support section 12 to produce an expansion force whereby to hold patient's oral cavity open. In such an occasion, patient's oral cavity will produce a reaction force upon the support section 12 and pressing the support section 12 to a contraction state. The expansion element 3 will give the support section 12 a restoration fore again to expand the support section 12. Such expansion and contraction interaction will proceed repeatedly to produce rehabilitation effect desired. When the expansion element 3 has outdone its elasticity, a new expansion element 3' with a greater elasticity coefficient may be used to replace the used expansion element 3 (shown in FIG. 3-4). After rehabilitation exercise is finished, user may grasp the body 1 to pull the support section 12 out of patient's oral cavity. It is a simple operation and hygienic too.

FIG. 4-1 shows the third embodiment of this invention. It has a body 1 at one end and a substantially trapezoid-shaped support section 12' at another end. The support section 12' has an upper crunching section 121' formed at a slant upper side thereof and a lower crunching section 122' formed at the bottom side and a taper front end 125'. The upper crunching section 121' has a plurality of bulged stubs 123' formed thereon and the lower crunching section 122' has a plurality of ditch grooves 124' formed thereon.

Referring to FIGS. 4-2 and 4-3, this embodiment may help patients to maintain rehabilitation result done in day time when they sleep at night. When in use, the patient may gradually insert the support section 12' into the mouth through the taper end 125' and use teeth to crunch the upper and lower crunching sections 121' and 122'. The bulged stubs 123' and ditch grooves 124' will help to keep the support section 12' securely in the oral cavity without slipping away during sleep and to maintain patients' oral cavity at an expansion size desired. Depend on patient's rehabilitation progress, the support section 12' may be gradually inserted into patient's oral cavity from the relatively thin front end to the thicker rear end for expanding the oral cavity to a larger extent desired. This will help to speed up rehabilitation.

All of above embodiments are simply structured and easy to use. They can help doing oral rehabilitation at a lower cost. The characteristics of the materials used also provide suitable protection effect. Take the first embodiment for instance, the pressure-resistant blade 2 is held in the compartment 11. Hence in the event that the blade 2 is broken incidentally, it won't hurt the patient. Patient may do rehabilitation safely.

While the present invention has been particularly shown and described with reference to preferred embodiments, it will be understood by those skilled in the art that various changes in form and detail may be without departing from the spirit and scope of the present invention.

What is claimed is:

1. An oral rehabilitation device for helping patients to do oral rehabilitation, comprising:

a body having a transverse compartment with two side openings and one end thereof extended to form a support section, wherein the body has a first expansion coefficient; and at least one expansion element held in the support section and having a second expansion coefficient;

wherein the support section contained expansion element has different expansion force and is capable of expanding patient's oral cavity by force when the support section is held and crunched in patient's oral cavity, and patient's repeatedly crunching movement done when the oral cavity is expanded to a selected extend is able to enhance rehabilitation effect, and the support section is removable from the oral cavity by pulling the body outward when the rehabilitation is finished, wherein the support section is an annular hollow member and made of a tenacious material and is formed at a size for fitting to patients' oral cavity, wherein the expansion element is made of a tenacious material and is an elongate member curled in a roll for containing in the hollow portion of the support section.

* * * * *